US006978777B2

(12) United States Patent
Pestrue et al.

(10) Patent No.: US 6,978,777 B2
(45) Date of Patent: Dec. 27, 2005

(54) COOKING STOVE INCLUDING INVERTIBLE SUPPORT RACK, SUPPORT RACK WITH DUAL COOKING SURFACES, AND METHODS OF USING SAME

(75) Inventors: Jeffrey A. Pestrue, St. Louis, MI (US); Robert Eastman, III, Flint, MI (US); Robert Butcher, Flushing, MI (US)

(73) Assignee: Eastman Holding Company, Flushing, MI (US)

( * ) Notice: Subject to any disclaimer, the term of this patent is extended or adjusted under 35 U.S.C. 154(b) by 0 days.

(21) Appl. No.: 10/717,980

(22) Filed: Nov. 20, 2003

(65) Prior Publication Data

US 2005/0109330 A1 May 26, 2005

(51) Int. Cl.[7] ..... F24B 3/00
(52) U.S. Cl. ..... 126/25 R; 126/30; 126/25 AA
(58) Field of Search ..... 126/25 R, 30, 126/25 AA, 40, 39 B

(56) References Cited

U.S. PATENT DOCUMENTS

| | | | | |
|---|---|---|---|---|
| 730,268 | A * | 6/1903 | Keller | 126/39 H |
| 2,825,325 | A | 3/1958 | Ross | |
| 4,062,341 | A | 12/1977 | Panzarella | |
| 4,313,416 | A | 2/1982 | Lau | |
| D265,882 | S | 8/1982 | Shih | |
| 4,530,345 | A | 7/1985 | Christiansen | |
| 4,607,613 | A | 8/1986 | Toldi | |
| 4,726,350 | A | 2/1988 | Steinhauser | |
| 4,759,339 | A | 7/1988 | Hefling | |
| 4,862,792 | A | 9/1989 | Lerma, Jr. | |
| 4,886,045 | A | 12/1989 | Ducate, Jr. et al. | |
| 5,104,080 | A | 4/1992 | Berger | |
| 5,158,067 | A | 10/1992 | Dutro et al. | |
| 5,558,008 | A | 9/1996 | Jenkins | |
| 5,632,265 | A | 5/1997 | Koziol | |
| 5,979,431 | A | 11/1999 | Hamilton et al. | |
| 5,992,408 | A | 11/1999 | Chen | |
| 6,067,978 | A | 5/2000 | Schlosser et al. | |
| 6,098,611 | A | 8/2000 | Fillmore | |
| 6,131,561 | A | 10/2000 | Maxwell et al. | |
| 6,146,132 | A | 11/2000 | Harneit | |
| 6,189,530 | B1 | 2/2001 | Shingler | |
| 6,192,878 | B1 | 2/2001 | Waters | |

(Continued)

FOREIGN PATENT DOCUMENTS

WO WO 02/066899 * 8/2002

*Primary Examiner*—Alfred Basichas
(74) *Attorney, Agent, or Firm*—Carrier, Blackman & Associates, P.C.; William D. Blackman; Joseph P. Carrier

(57) ABSTRACT

A stove for outdoor use includes a hollow shell formed from heat-tolerant material, and a substructure for supporting the shell. The stove also includes a burner assembly, operatively attached to the shell or to the substructure, and a vessel support rack for placement on the shell. The support rack is formed from multiple interconnected segments. A first vessel-supporting surface is defined on a first side of the support rack, for supporting a cooking vessel having a substantially flat lower surface. A second vessel-supporting surface is defined on a second side of the support rack, for supporting a cooking vessel having a substantially non-flat lower surface. The second vessel-supporting surface may be configured to support a concave cooking implement, such as a wok thereon. The support rack is configured to fit into the shell with either the first vessel-supporting surface or the second vessel-supporting surface facing upwardly.

19 Claims, 10 Drawing Sheets

U.S. PATENT DOCUMENTS

| | | | | |
|---|---|---|---|---|
| 6,244,263 | B1 | 6/2001 | Schlosser et al. | |
| 6,422,231 | B1 | 7/2002 | Hamilton et al. | |
| D463,215 | S | 9/2002 | Huang et al. | |
| 6,588,417 | B2 * | 7/2003 | Jones et al. | 126/215 |
| 6,589,046 | B2 | 7/2003 | Harneit | |
| 6,712,067 | B1 * | 3/2004 | Barbour et al. | 126/215 |

* cited by examiner

COOKING STOVE INCLUDING INVERTIBLE SUPPORT RACK, SUPPORT RACK WITH DUAL COOKING SURFACES, AND METHODS OF USING SAME

BACKGROUND OF THE INVENTION

1. Field of the Invention

The present invention relates to cooking stoves and to methods of using same. More particularly, the present invention relates to a gas stove including an invertible support rack, to an invertible support rack with dual cooking surfaces, and to methods of using the described stove and support rack.

2. Description of the Background Art

Gas-fired grills and stoves are widely used in the fields of residential and commercial cooking. In particular, outdoor gas grills, using compressed gaseous fuel such as propane, LPG or LNG are commercially available, and are commonly used for barbecue-style cooking.

A conventional outdoor gas grill generally includes a burner element positioned beneath heat-tolerant lava rocks or briquettes, and a grate or grilling surface, positioned above the burner assembly and briquettes. Aside from their general construction, the previously known outdoor gas grills can differ significantly in size, and can also differ as to what options a particular outdoor grill may include.

By way of example, an outdoor grilling apparatus may be stationary with removable grilling units (U.S. Pat. No. 5,632,265), portable, incorporating swing-out food and briquette grates (U.S. Pat. No. 4,862,792), or may include a height-adjustable work shelf attached to a main grill body (U.S. Pat. No. 5,104,080).

Additionally, some of the known outdoor gas stoveing apparatus may be equipped with a burner unit and associated support rack, similar to that of a kitchen range/cooktop, capable of cooking or warming food in a cooking utensil, such as a pot or pan.

Several variants of outdoor gas grills, incorporating at least one burner unit, are illustrated in U.S. Pat. Nos. 4,886,045, 6,067,978 and 6,192,878.

Additional examples of known outdoor cooking stoves include U.S. Pat. Nos. 2,825,325, 4,726,350, 4,759,339, 5,979,431, and 6,131,561.

Other examples of stoves, burners and adapters particularly designed for use with woks include those disclosed in U.S. Pat. Nos. D265,882, D463,215, 4,062,341, 4,313,416, 4,530,345, 4,607,613, 5,158,067, 5,558,008, and 6,189,530.

Although the known devices have some utility for their intended purposes, a need still exists in the art for an improved stove and vessel support rack which can be adapted to support cooking utensils having different shapes. In particular, there is a need for an improved cooking stove and vessel support rack which can be adapted to alternately support flat-bottomed cooking pans and woks with rounded bases.

SUMMARY OF THE INVENTION

In a first aspect thereof, the present invention provides a stove which can be adapted to alternately support flat-bottomed cooking pans and woks with rounded bases.

In a second aspect thereof, the present invention provides an invertible vessel support rack including dual cooking surfaces.

An embodiment of a stove according to the first aspect includes a hollow shell formed from heat-tolerant material, and a substructure for supporting the shell. The stove also includes a burner assembly, operatively attached to the shell or to the substructure, and a vessel support rack for engaging placement on the shell. At least part of the burner assembly is disposed inside of the shell.

The vessel support rack is formed from a plurality of interconnected segments. A first vessel-supporting surface is defined on a first side of the support rack, for supporting a cooking vessel having a substantially flat lower surface. A second vessel-supporting surface is defined on a second side of the support rack, for supporting a cooking vessel having a substantially non-flat lower surface. The second vessel-supporting surface may be configured to support a substantially concave cooking implement, such as a wok thereon. The shell is configured to receive the support rack thereon with either the first vessel-supporting surface or the second vessel-supporting surface facing upwardly.

Accordingly, it is an object of the present invention to provide an outdoor stove apparatus including an invertible grill, which can be arranged to support either a flat-bottomed cooking pan or a wok.

It is another object of the present invention to provide an invertible support rack having different vessel-supporting surfaces on two sides thereof.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Figure 1:
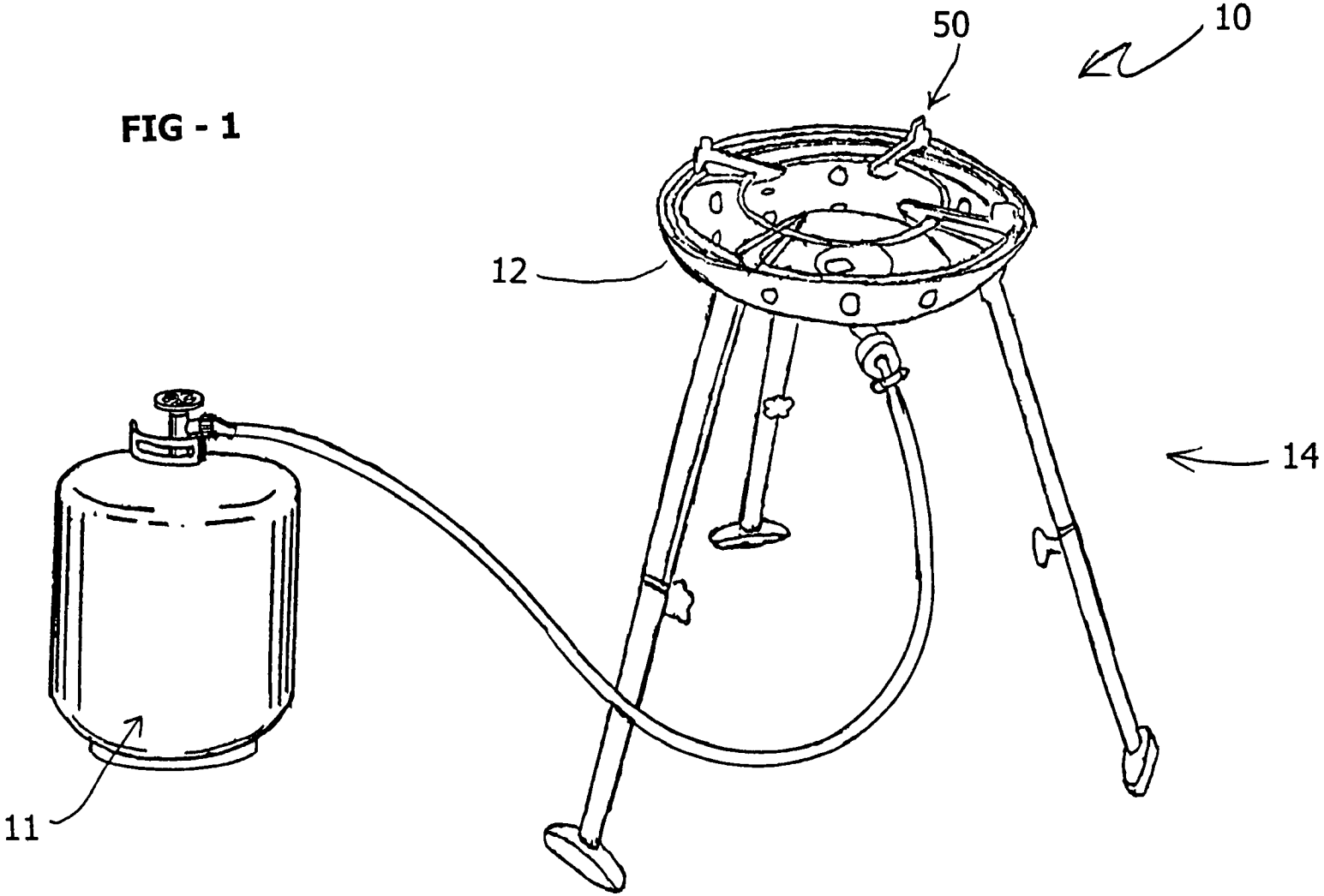
FIG. 1 is a perspective view of an outdoor gas stove according to a selected illustrative embodiment of the present invention, shown with a compressed fuel storage tank.

Referring now to the drawings, a gas stove apparatus for outdoor use, in accordance with a first illustrative embodiment of the present invention, is shown generally at 10, along with a compressed fuel tank 11.

The stove 10 includes a hollow shell 12 formed from heat-tolerant material, and a substructure 14 for supporting the shell. The stove 10 also includes a burner assembly 16, operatively attached to the shell or to the substructure, and a vessel support rack 50 for stable placement on the shell 12. The burner assembly 16 may be substantially as described in the disclosure of U.S. patent application Ser. No. 10/165,607, filed Jun. 7, 2002. The disclosure of U.S. patent application Ser. No. 10/165,607 is hereby incorporated by reference, along with the drawings thereof.

The Shell

The shell 12 may be formed from stamped sheet metal, which may be coated with a ceramic material for durability. The shell 12 has a burner access hole 13 formed therein to accommodate a portion of the burner assembly 16.

The shell 12 may also have a plurality of vent holes 15 formed therein to admit combustion air. The arrangement and number of these vent holes 15 is important, to admit enough air to ensure a good air/fuel ratio for efficient combustion of the fuel.

In the depicted embodiment, the shell 12 also has a plurality of alignment slots 17 formed therein to receive alignment tabs of the vessel support rack 50.

Figure 3A:
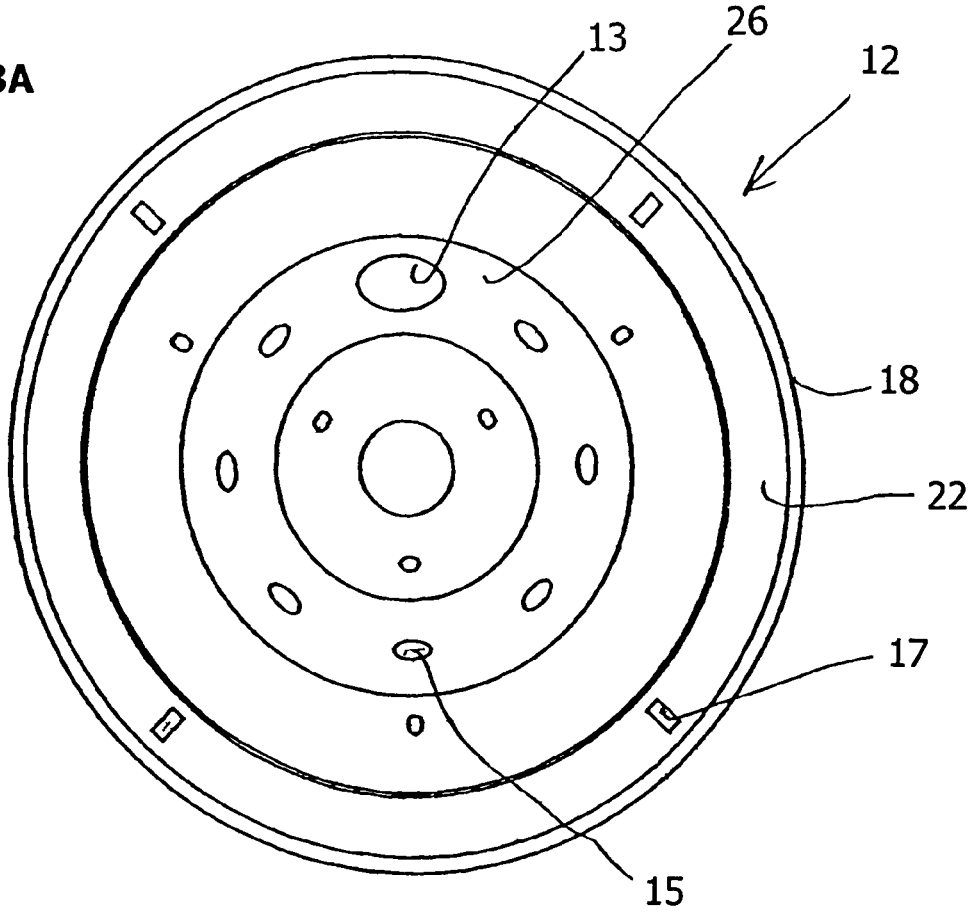
FIG. 3A is a top view of the shell in isolation showing openings formed therein to provide air vents, openings for receiving alignment tabs of the support rack, and an opening for providing access for the burner hose.
Figure 3B:
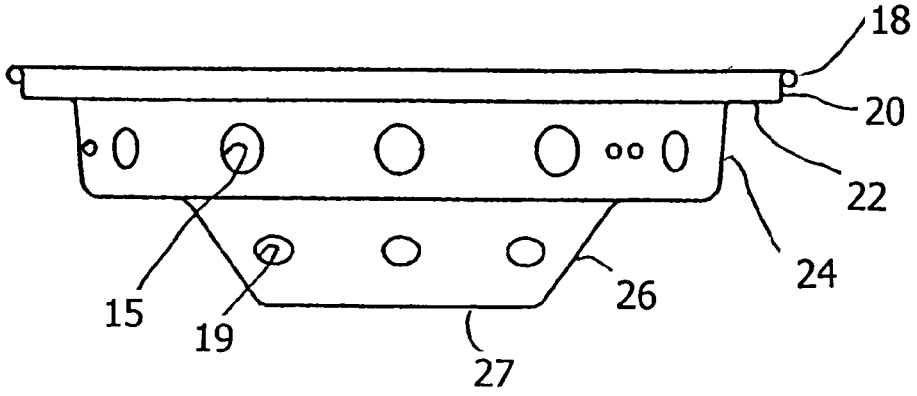
FIG. 3B is a side view of the shell of FIG. 3A showing the irregular vertical profile of the shell.

Referring now to FIGS. 3A–3B, the shell 12, in the depicted embodiment, has a substantially circular outline as viewed from above, and has a rolled bead 18 extending around the outer edge thereof for strength and reinforcement. The shell 12 has a substantially vertical upper side wall portion 20 extending downwardly from the rolled bead 18, and extends inwardly from the bottom of the side wall portion 20 to form a substantially horizontal upper ledge 22, which is provided for supporting the vessel support rack 50 thereon. As seen in FIG. 3A, the alignment slots 17 are formed in the ledge 22 part of the shell 12. The alignment slots 17 provide a plurality of alignment connectors for receiving mating connectors of the vessel support rack 50.

Figure 2A:
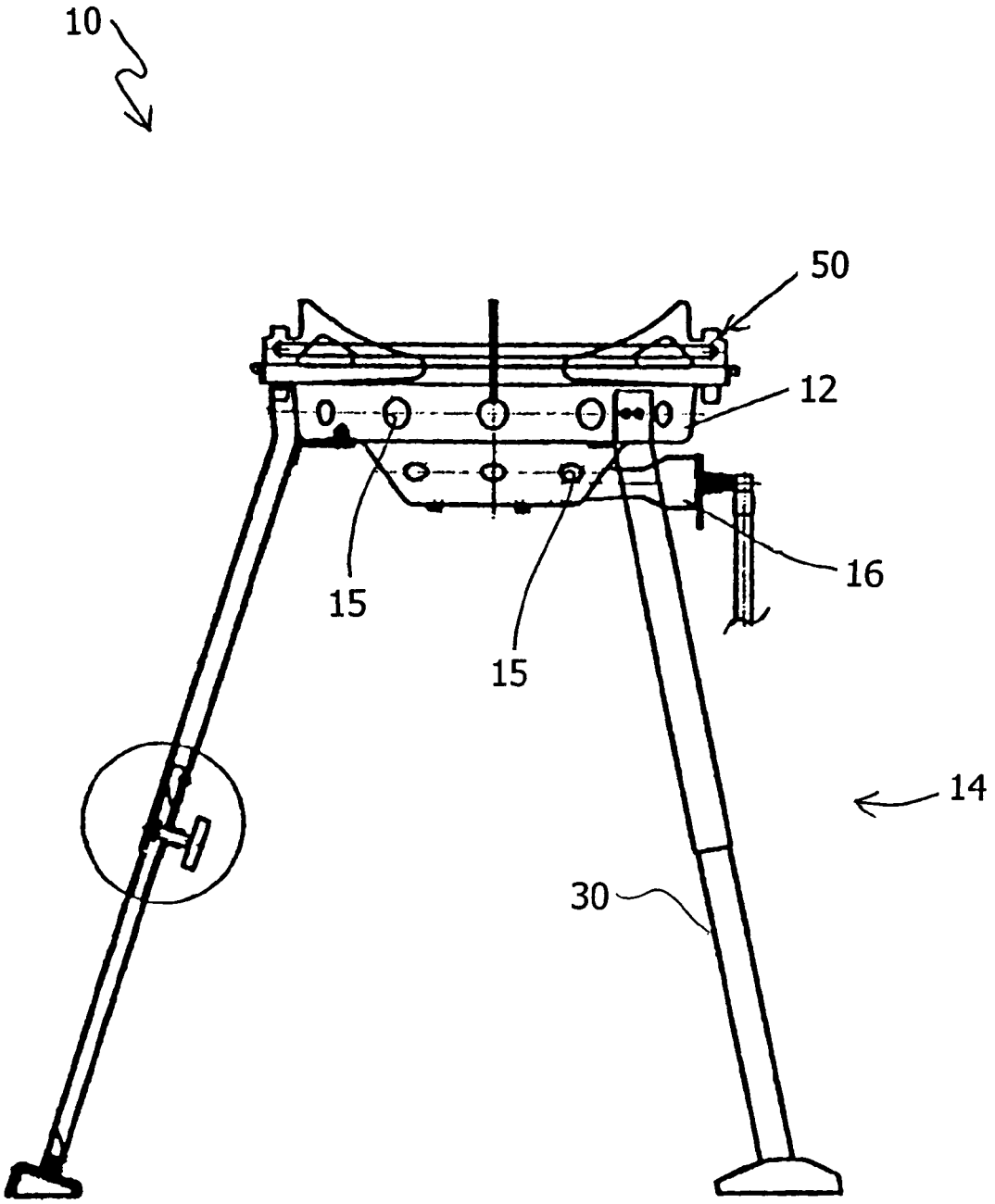
FIG. 2A is a side plan view of the gas stove of FIG. 1, shown without the fuel tank and with a supply hose partially cut away.
Figure 2B:
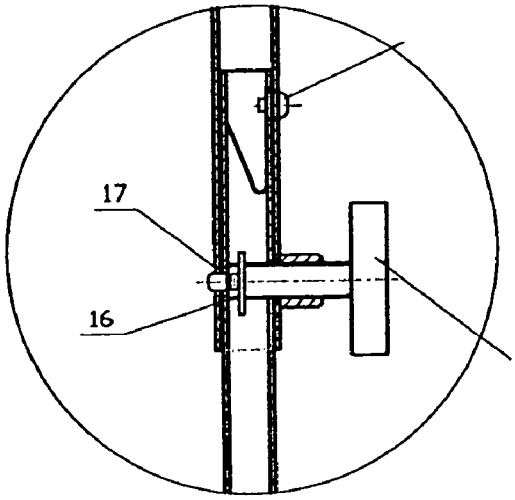
FIG. 2B is a detail sectional view of the circled area of FIG. 2A showing the locking mechanism for height adjustment in the height adjustable legs.
Figure 2C:
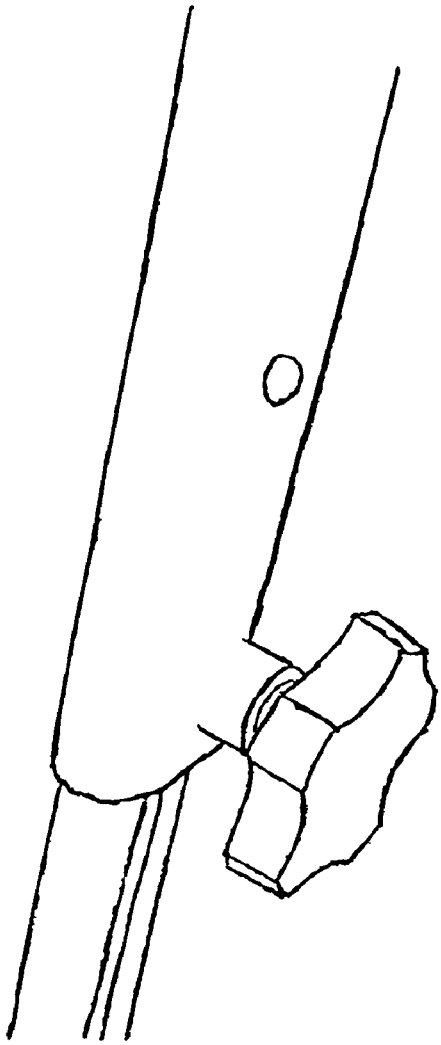
FIG. 2C is a detail perspective view of the locking mechanism of FIG. 2B.

The shell 12 extends downwardly from the inner edge of the ledge 22 to form a spacer section 24, for spacing the support rack 50 away from the burner assembly 16. The spacer section 24 may have a plurality of spaced-apart vent holes 15 formed therein, as shown. At the bottom of the spacer section 24, the shell 12 extends inwardly again and then tapers in and down to form a substantially bowl-shaped burner housing 26. The burner access hole 13 is formed in the side of the burner housing 26, to allow an inlet end of the burner 16 to extend outwardly from the shell 12, as shown in FIG. 2. The burner housing 26, in turn, may also have a plurality of vent holes 19 formed therein to admit combustion air. At the base of the burner housing 26, a floor 27 extends across the bottom of the shell 12.

The Substructure

Figure 4:
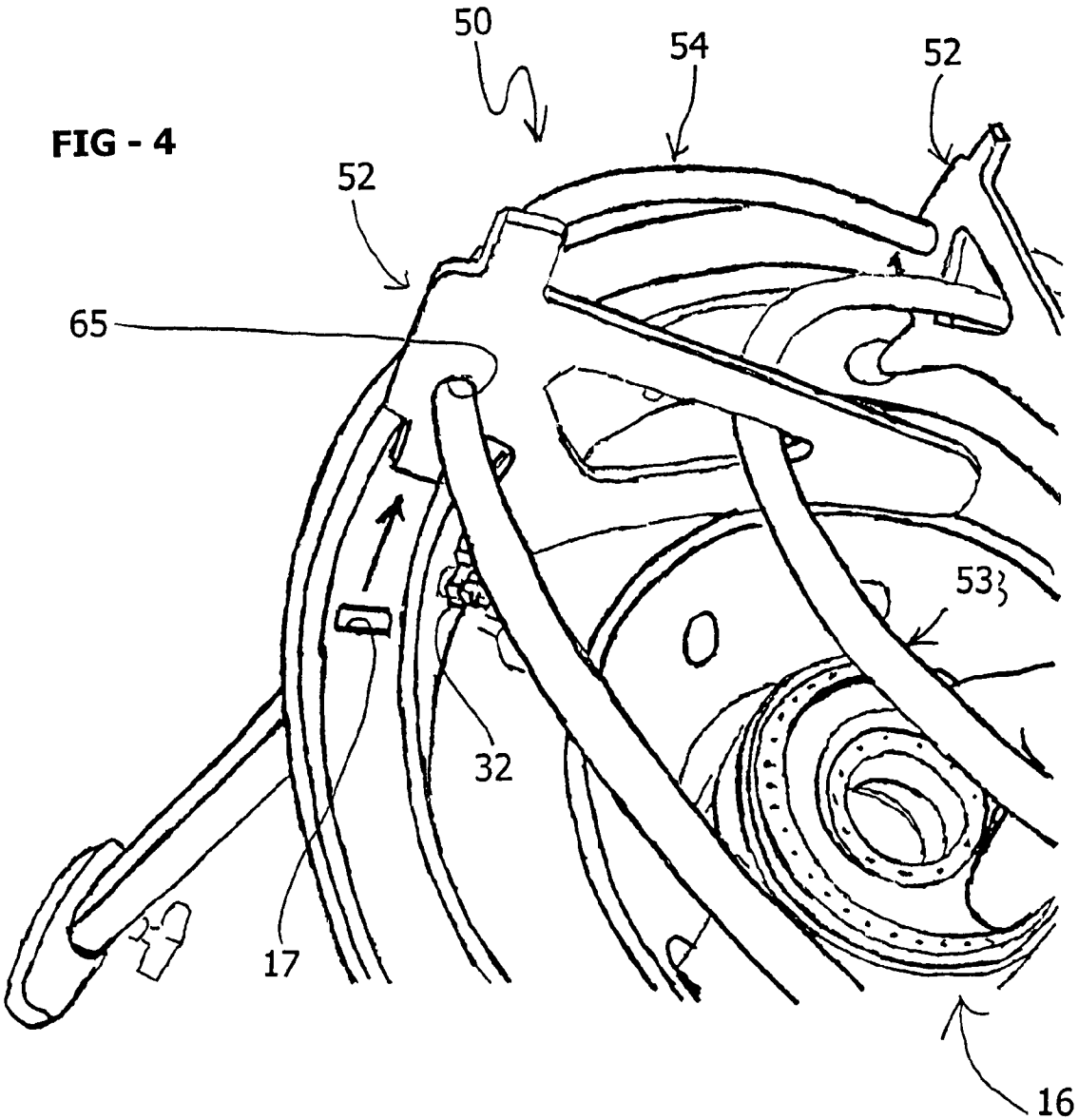
FIG. 4 is partial perspective view of the gas stove apparatus showing the first and second alignment tabs formed on respective upper and lower surfaces of the bracket, and showing the tab on the lower surface removed from the alignment slot as indicated by the arrow.
Figure 5B:
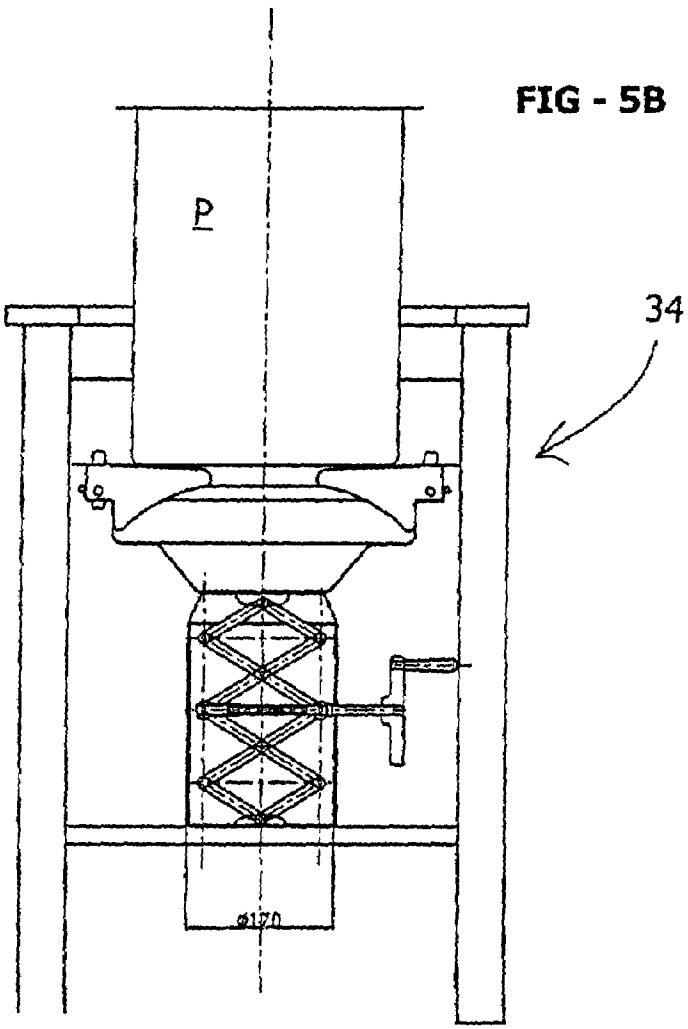
FIG. 5B is a side sectional view of a second embodiment of the substructure of FIG. 5A showing the jack retracted such that the shell and burner are partially positioned within the cabinet.
Figure 5A:
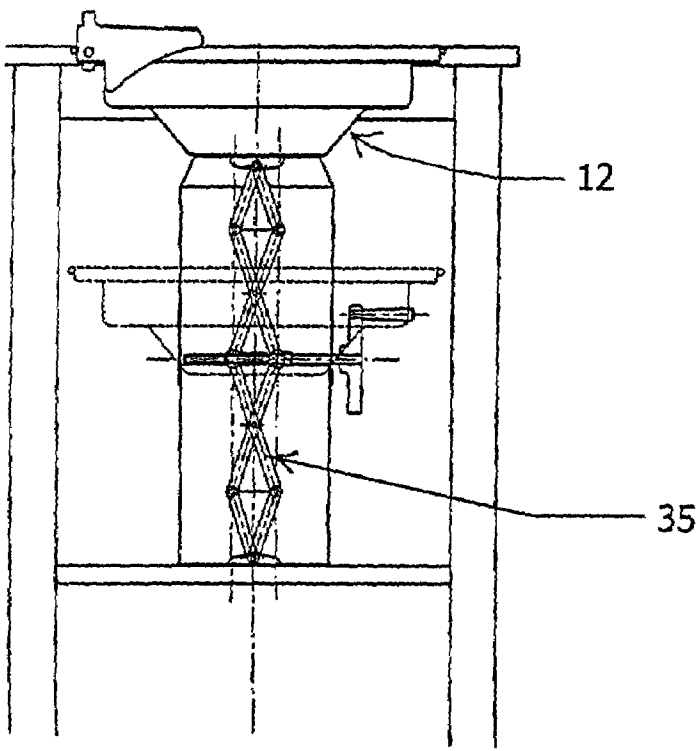
FIG. 5A is a side sectional view of a second embodiment of the substructure showing a cabinet surrounding a height adjustable jack wherein the jack is extended such that the upper edge of the shell lies flush wit the upper surface of the cabinet.

The substructure 14 is provided to elevate and support the shell 12. In the embodiment of FIGS. 1–2, the substructure 14 is made up of a plurality of height-adjustable legs 30, which are affixed to the shell 12 by welding or by the use of fasteners 32 (FIG. 4) such as nuts and bolts. Alternatively, the substructure 14 may be provided in the form of a cabinet 34 (FIG. 5), which may optionally include a height-adjustable jack 35. The jack may be used to lower the shell 12 and burner 16 to a recessed position as shown in FIG. 5B, to accommodate a large cooking pot P. An example of a cabinet which may be used is shown and described in U.S. patent application Ser. No. 09/971,866, filed Oct. 5, 2001. The disclosure of U.S. patent application Ser. No. 09/971,866 is hereby incorporated by reference, along with the drawings thereof.

The Support Rack

Figure 6:
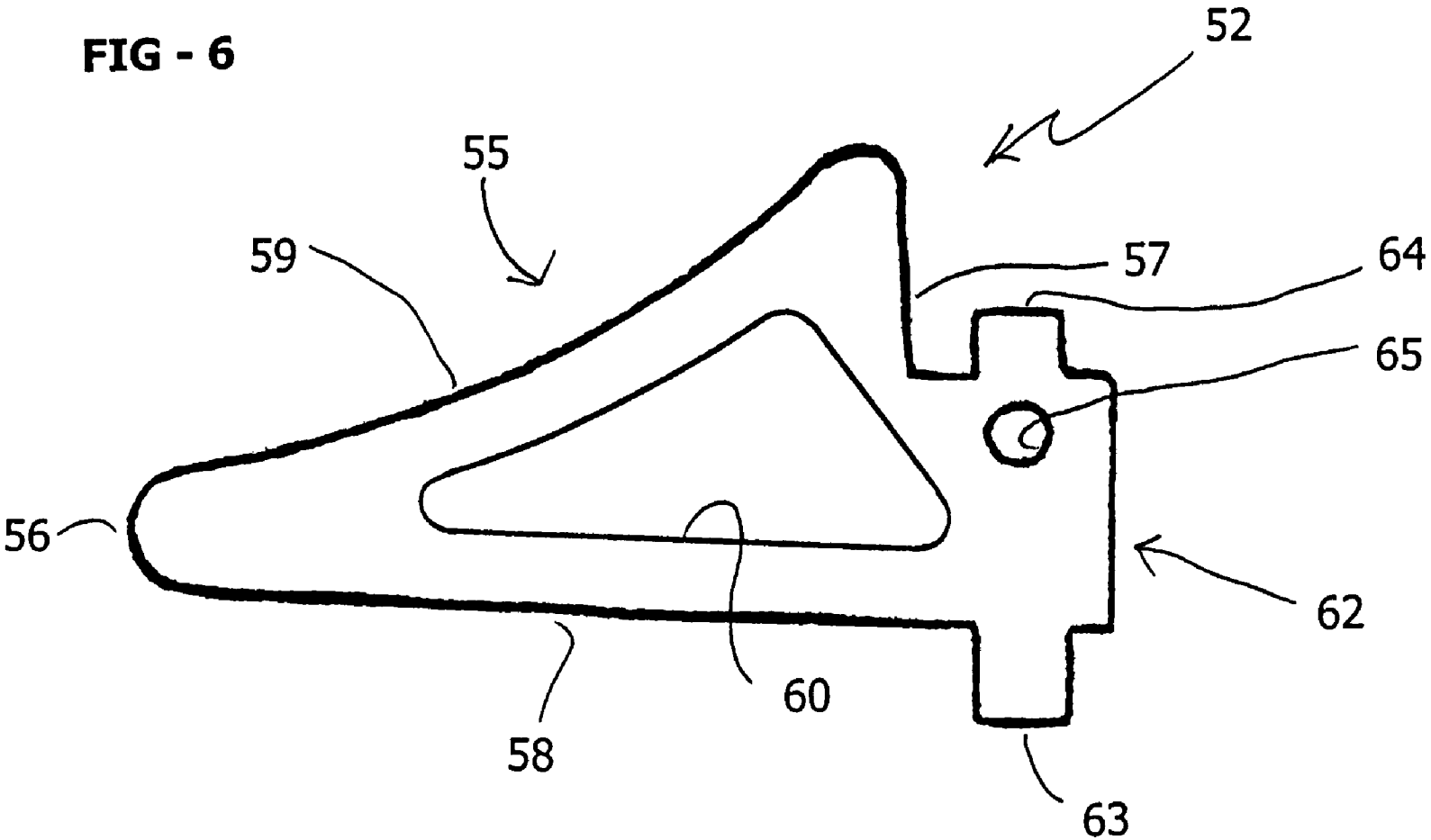
FIG. 6 is a side view of the bracket showing its generally right-triangular shape wherein one edge of the triangle is concave and wherein the alignment tabs extend from an adjacent edge.

The support rack 50 is formed from a plurality of interconnected segments. In the depicted embodiment, the support rack includes a plurality of stamped metal rack brackets 52 interconnected by inner and outer rings 53, 54, respectively. As shown in FIG. 6, each of the rack brackets 52 has a main body portion 55 which is roughly triangular in shape, with a narrow inner end 56 and a wider outer end 57. The main body portion 55 of the bracket 52 has a first side edge 58 which is substantially flattened, and a second side edge 59 which is substantially curved. Optionally, a substantially triangular cutout 60 may be formed in the bracket 52, as shown, and the inner ring 53 may pass through the cutout 60, as shown in FIG. 4.

Each rack bracket 52 also includes an extension 62 extending outwardly from the outer end 57 of the main body portion 55, with respective first and second integral tabs 63, 64 extending vertically in opposite directions thereon. The extension 62 may also have a through hole 65 formed therethrough, as shown, and the outer ring 54 may extend through the through holes 65 of each of the rack brackets 52, to help link the brackets together to form the overall vessel support rack 50.

Figure 7B:
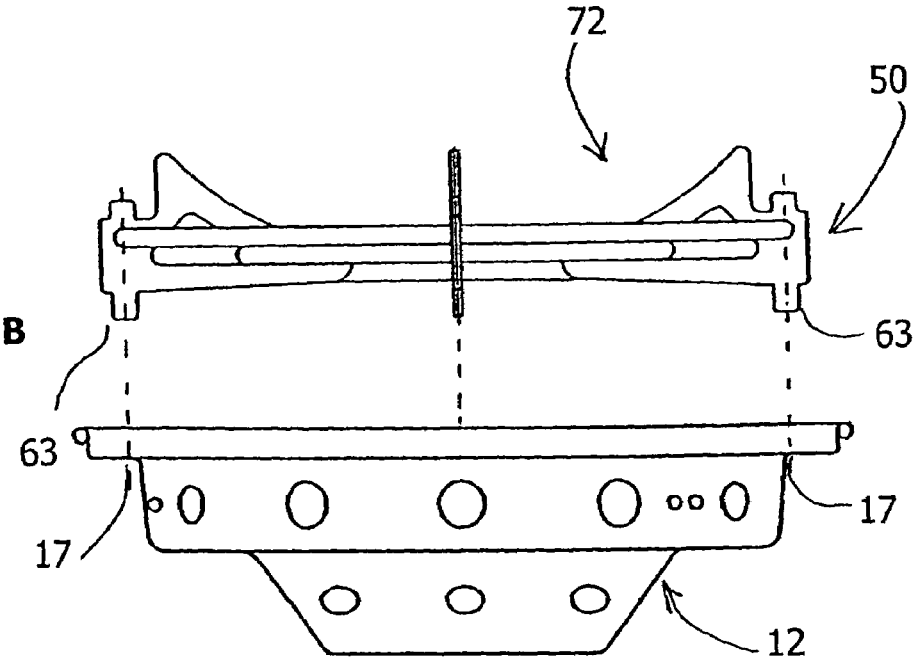
FIG. 7B is an exploded side view of the shell and support rack showing the support rack oriented so that curved vessel supporting surface is facing upward, and the first tabs of the rack bracket are facing downward to be received within alignment slots formed in the shell.
Figure 7A:
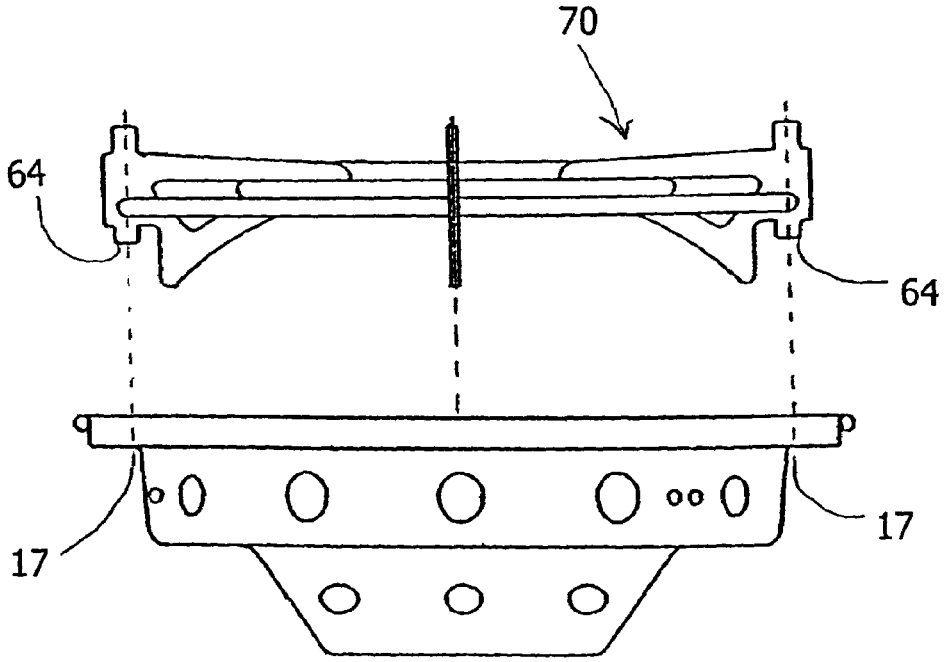
FIG. 7A is an exploded side view of the shell and support rack showing the support rack oriented so that the substantially flat vessel supporting surface is facing upward, and the second tabs of the rack brackets are facing downward to be received within alignment slots formed in the shell.
Figure 8B:
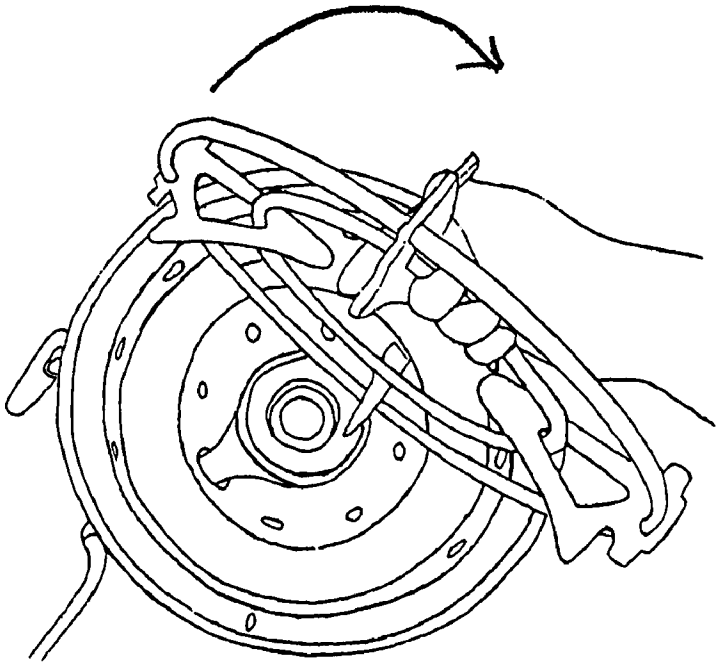
FIG. 8B is an upper perspective view of the outdoor gas stove of FIG. 8A in which the support rack is lifted upwards away from the shell, and then rotated in the direction of the arrow until the support rack is inverted.
Figure 8A:
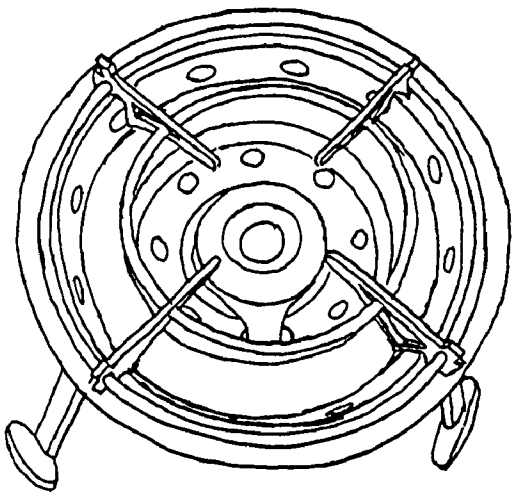
FIG. 8A is an upper perspective view showing the outdoor gas stove with the support rack positioned on the shell in an orientation in which the substantially flat vessel supporting surface is facing upward.
Figure 8D:
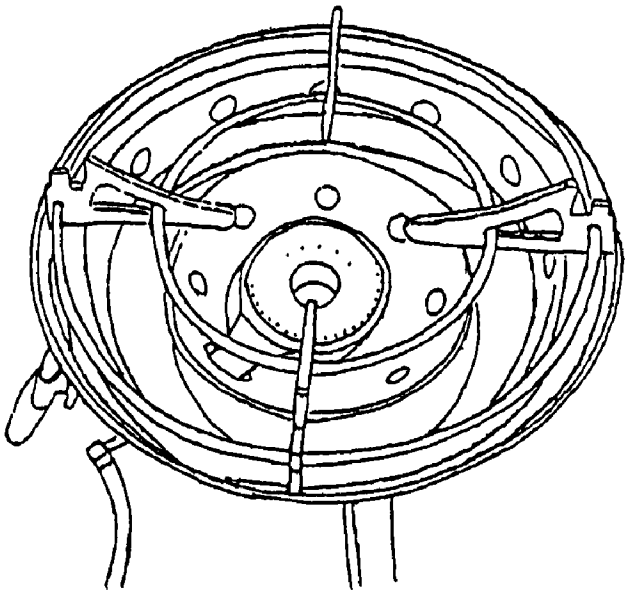
FIG. 8D is an upper perspective view of the outdoor gas stove of FIG. 8C in which the support rack is positioned on the shell in an orientation in which the curved vessel supporting surface is facing upward.
Figure 8C:
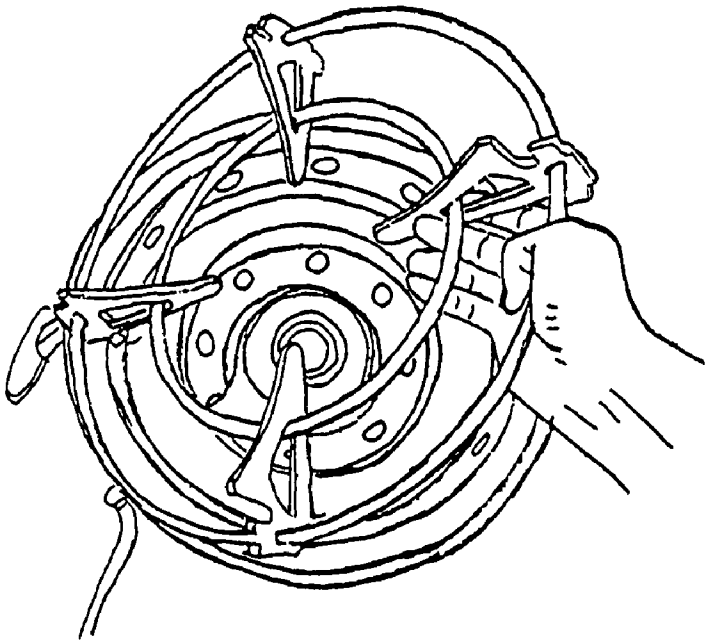
FIG. 8C is an upper perspective view of the outdoor gas stove of FIG. 8B in which the inverted support rack is re-installed on the upper surface of the shell.

Referring now to FIG. 7A, it will be seen by orienting the vessel support rack 50 with the flat side edges 58 of the brackets 52 facing upwardly, and by placing the second tabs 64 of the rack brackets into the alignment slots 17 of the shell 12, that a first, substantially flat vessel-supporting surface 70 is defined on a first side of the support rack. The first vessel-supporting surface 70 is provided for supporting a cooking vessel having a substantially flat lower surface, such as the cooking pot P shown in FIG. 5B.

Conversely, the vessel support rack may be inverted as shown in FIGS. 8A–8D. By orienting the vessel support rack 50 with the curved side edges 59 of the brackets 52 facing upwardly (FIG. 7B) and by placing the first tabs 63 of the rack brackets into the alignment slots 17 of the shell 12, a second, substantially bowl-shaped vessel-supporting surface 72 is defined on a second side of the support rack. The second vessel-supporting surface is provided for supporting a cooking vessel having a substantially rounded lower surface, particularly a wok.

The shell 12 is configured to support the vessel support rack 50 thereon with either the first vessel-supporting surface 70 or the second vessel-supporting surface 72 facing upwardly.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A cooking stove, comprising:

a hollow shell formed from heat-tolerant material, said shell having a plurality of spaced-apart alignment openings formed therein, where said alignment openings are spaced away from an upper edge of said shell;

a substructure for supporting said shell;

a burner assembly operatively attached to said shell or to said substructure; and a vessel support rack for placement on said shell, said vessel support rack defining a first vessel-supporting surface on a first side thereof for supporting a cooking vessel having a substantially flat lower surface, said vessel support rack further defining a second vessel-supporting surface on a second side thereof for supporting a cooking vessel having a substantially non-flat lower surface, said second vessel supporting surface being curved such that an outer edge thereof is vertically offset relative to an inner portion thereof, wherein said vessel support rack has a plurality of projections thereon which fit into said alignment openings of said shell, whereby said vessel support rack can be stably supported on said shell;

wherein said shell is configured to support said vessel support rack thereon with either said first vessel-supporting surface or said second vessel-supporting surface facing upwardly.

2. The stove of claim 1, wherein said second vessel-supporting surface is substantially concave.

3. The stove of claim 2, wherein said vessel support rack is configured to support a wok on said second vessel-supporting surface.

4. The stove of claim 1, wherein said vessel support rack comprises a plurality of interconnected support brackets.

5. The stove of claim 1, wherein said vessel support rack comprises at least one circular metal ring interconnecting a plurality of support segments.

6. The stove of claim 1, wherein said substructure comprises a plurality of height-adjustable legs.

7. The stove of claim 1, wherein said shell has an intermediate ledge portion formed therein for supporting said vessel support rack thereon.

8. A cooking stove, comprising:

a hollow shell formed from heat-tolerant material;

a substructure for supporting said shell;

a burner assembly operatively attached to said shell or to said substructure; and a vessel support rack for placement on said shell, said vessel support rack defining a first vessel-supporting surface on a first side thereof for supporting a cooking vessel having a substantially flat lower surface, said vessel support rack further defining a second vessel-supporting surface on a second side thereof for supporting a cooking vessel having a substantially non-flat lower surface, said second vessel supporting surface being curved such that an outer edge thereof is vertically offset relative to an inner portion thereof, wherein said vessel support rack comprises a plurality of interconnected support brackets, wherein each of said support brackets has a first projection on said first side thereof, and a second projection on said second side thereof;

and wherein said shell is configured to support said vessel support rack thereon with either said first vessel-supporting surface or said second vessel-supporting surface facing upwardly.

9. A cooking stove, comprising:

a hollow shell formed from heat-tolerant material, wherein said shell has a plurality of vent holes formed therein, each of said vent holes disposed at a respective location spaced apart from an upper edge of the shell, the vent holes used to admit combustion air;

a substructure for supporting said shell;

a burner assembly operatively attached to said shell or to said substructure; and a vessel support rack for placement on said shell, said vessel support rack defining a first vessel-supporting surface on a first side thereof for supporting a cooking vessel having a substantially flat lower surface.

said vessel support rack further defining a second vessel-supporting surface on a second side thereof for supporting a cooking vessel having a substantially non-flat lower surface, said second vessel supporting surface being curved such that an outer edge thereof is vertically offset relative to an inner portion thereof;

wherein said shell is configured to support said vessel support rack thereon with either said first vessel-supporting surface or said second vessel-supporting surface facing upwardly.

10. A cooking stove, comprising:

a hollow shell formed from heat-tolerant material;

a substructure for supporting said shell;

a burner assembly operatively attached to said shell or to said substructure, at least part of said burner assembly being disposed inside of said shell; and a vessel support rack for engaging placement on said shell, said vessel support rack comprising a plurality of interconnected support segments which cooperate to define a first vessel-supporting surface on a first side thereof for supporting a cooking vessel having a substantially flat lower surface, said support segments further cooperating to define a second vessel-supporting surface on a second side of said vessel support rack for supporting a cooking vessel having a substantially non-flat lower surface, said second vessel-supporting surface being curved such that an outer periphery thereof is higher than an inner portion thereof;

wherein said shell is configured to support said vessel support rack thereon with either said first vessel-supporting surface or said second vessel-supporting surface facing upwardly, and wherein the highest portion of the stove is defined by the upward-facing surface of the vessel support rack, when the stove is arranged with the vessel support rack supported on the shell.

11. A cooking stove, comprising:

a hollow shell comprising a plurality of spaced-apart alignment connectors configured to receive mating connectors of a vessel support rack, each of said alignment connectors positioned on said shell at a respective location spaced apart from an edge of said shell;

a substructure for supporting said shell;

a burner assembly, at least part of which is disposed within said shell; and a vessel support rack for placement on said shell, said vessel support rack comprising a plurality of interconnected support brackets which cooperate to define a first, substantially planar vessel-supporting surface on a first side of said vessel support rack, said support brackets further cooperating to define a second, substantially concave vessel-supporting surface on a second side of said vessel support rack which is substantially opposite said first side thereof;

said vessel support rack further comprising a plurality of spaced-apart mating connectors on said first side thereof which are alignable with said alignment connectors of said shell; and a plurality of spaced-apart mating connectors on said second side thereof which are alternately alignable with said alignment connectors of said shell;

whereby said vessel support rack is installable in aligned relation to said shell with either said first side or said second side thereof facing upwardly.

12. The stove of claim 11, wherein each of said support brackets has a first projection on said first side thereof, and a second projection on said second side thereof.

13. The stove of claim 11, wherein said vessel support rack comprises at least one metal ring interconnecting said support brackets.

14. The stove of claim 11, wherein said substructure comprises a plurality of height-adjustable legs.

15. The stove of claim 11, wherein said housing shell has a plurality of vent holes formed therein to admit combustion air.

16. The stove of claim 11, wherein said shell has an intermediate ledge portion formed therein for supporting said vessel support rack thereon.

17. An invertable vessel support rack for placement on a stove, said vessel support rack defining a first vessel-supporting surface on a first side thereof for supporting a cooking vessel having a substantially flat lower surface, said vessel support rack further defining a second vessel-supporting surface on a second side thereof for supporting a cooking vessel having a substantially non-flat lower surface;

wherein said vessel support rack is configured to fit on a stove with either said first vessel-supporting surface or said second vessel-supporting surface facing upwardly, and wherein said vessel support rack comprises a plurality of radially extending plate members, each plate member comprising opposed edges and being oriented vertically such that the collective opposed edges of the plurality of plate members correspond to respective first and second vessel-supporting surfaces, one of said opposed edges being substantially curved such that the second vessel supporting surface is shaped in a manner to support a non-flat surface of a cooking pan thereon, wherein at least two of said plate members have a first projection on a first side thereof, and a second projection on a second side thereof, respectively.

18. The vessel support rack of claim 17, wherein said second vessel-supporting surface is substantially concave.

19. The vessel support rack of claim 18, wherein said vessel support rack is configured to support a wok on said second vessel-supporting surface.

* * * * *